US006351888B1

(12) United States Patent
Brown et al.

(10) Patent No.: US 6,351,888 B1
(45) Date of Patent: Mar. 5, 2002

(54) WINDOW PAINT SCRAPER

(76) Inventors: Alan Brown; Louise Brown, both of 37 Rogersmead, Tenterden, Kent TN30 6LF (GB)

( * ) Notice: Subject to any disclaimer, the term of this patent is extended or adjusted under 35 U.S.C. 154(b) by 0 days.

(21) Appl. No.: 09/523,124

(22) Filed: Mar. 10, 2000

(30) Foreign Application Priority Data

Feb. 16, 1999 (GB) ..... 9905852

(51) Int. Cl.[7] ..... A47L 13/02

(52) U.S. Cl. ..... 30/169; 30/289; 30/294; 15/236.01

(58) Field of Search ..... 30/169, 172, 539, 30/286, 289, 294; 15/236.01, 236.08, 257.01

(56) References Cited

U.S. PATENT DOCUMENTS 3,670,414 A * 6/1972 Stecker ..... 30/169
4,071,952 A * 2/1978 Meshulam et al. ..... 30/294
4,481,689 A * 11/1984 Westmoreland ..... 30/169
4,709,478 A * 12/1987 Cortelyou, Jr. ..... 30/169
5,009,009 A * 4/1991 Stinson ..... 30/172
5,289,609 A * 3/1994 Olson ..... 15/257.01
5,309,598 A * 5/1994 Carpenter ..... 30/169
5,479,950 A * 1/1996 Andrews ..... 30/539
5,933,905 A * 8/1999 Hess ..... 15/160

* cited by examiner

*Primary Examiner*—Hwei-Slu Payer

(57) ABSTRACT

A window paint scraper for scraping paint from a window while protecting the window frame from the blade. The window paint scraper includes a head portion, a distal end, a proximal end, and a pair of sides. The distal end has a slot therein adapted for removably receiving a blade. A sharp edge of the blade extends away from the distal end. The sharp edge has a width generally equal to a width of the distal end. A handle portion is elongate and is integrally coupled to the proximal end of the head portion. A pair of spacing members places a distance between the sides of the head portion and a window frame. Each of the spacing members is integrally coupled to one of the sides of the head portion. Each of the spacing members is abutted against a junction of the sides and the distal end of the head portion. A bumper protects the widow frame from the sharp edge of the blade. The bumper is integrally coupled to and extends away from the distal end of the head portion. The bumper extends away from the distal end such that the bumper will prevent the blade from touching the window frame when the blade is abutted against the widow pane.

13 Claims, 4 Drawing Sheets

FIG.1
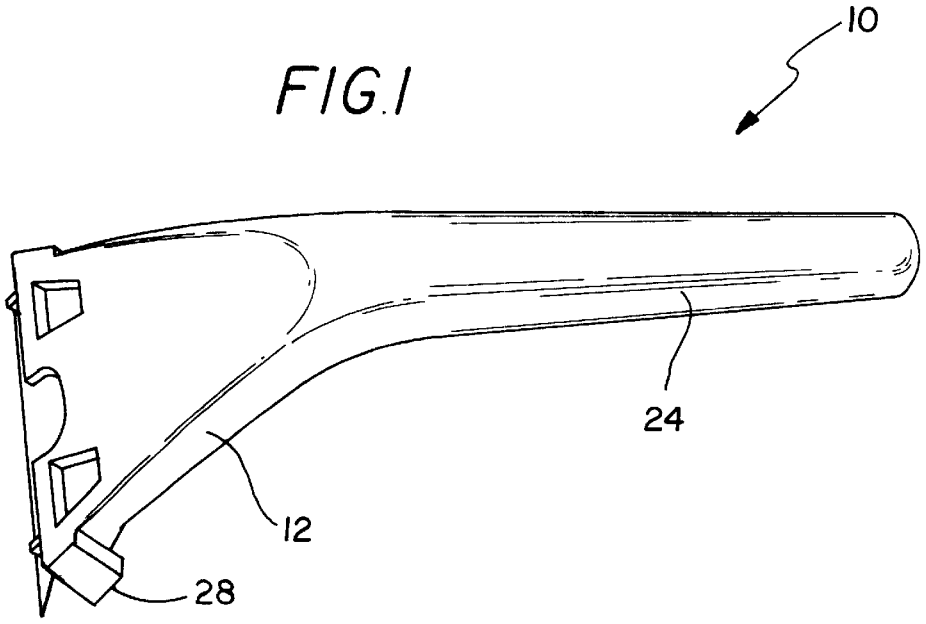
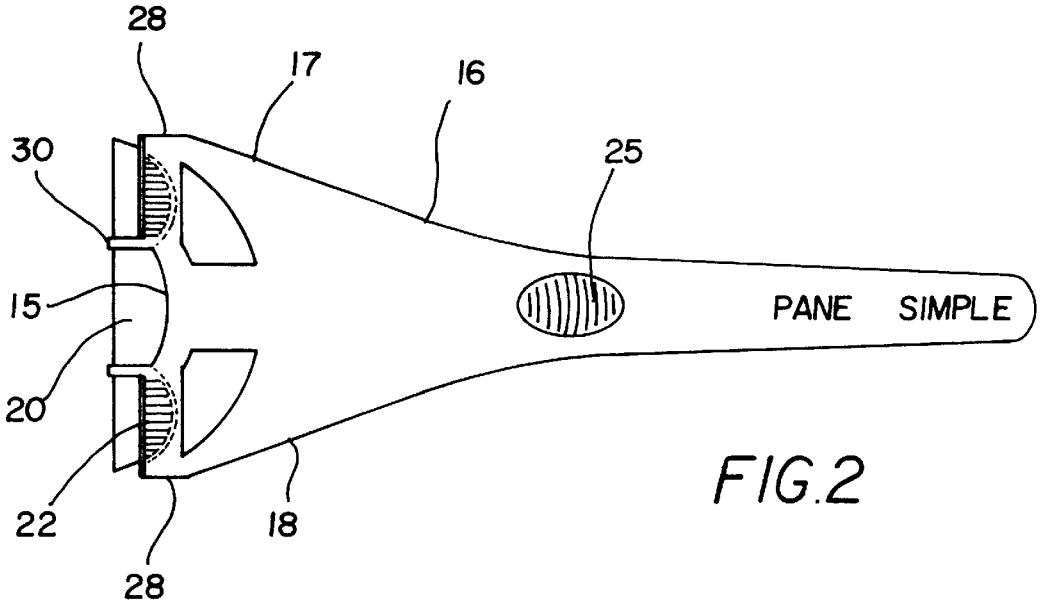
FIG.2

WINDOW PAINT SCRAPER

BACKGROUND OF THE INVENTION

1. Field of the Invention

The present invention relates to paint scrapers and more particularly pertains to a new window paint scraper for scraping paint from a window while protecting the window frame from the blade.

2. Description of the Prior Art

The use of paint scrapers is known in the prior art. More specifically, paint scrapers heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 5,289,609; U.S. Pat. No. 4,709,478; U.S. Pat. No. 2,787,056; U.S. Pat. No. 5,933,905; and U.S. Pat. No. 5,309,598.

While these devices fulfill their respective, particular objectives and requirements, the aforementioned patents do not disclose a new window paint scraper. The inventive device includes a head portion, a distal end, a proximal end, and a pair of sides. The distal end has a slot therein adapted for removably receiving a blade. A sharp edge of the blade extends away from the distal end. The sharp edge has a width generally equal to a width of the distal end. A handle portion is elongate and is integrally coupled to the proximal end of the head portion. A pair of spacing members places a distance between the sides of the head portion and a window frame. Each of the spacing members is integrally coupled to one of the sides of the head portion. Each of the spacing members is abutted against a junction of the sides and the distal end of the head portion. A bumper protects the widow frame from the sharp edge of the blade. The bumper is integrally coupled to and extends away from the distal end of the head portion. The bumper extends away from the distal end such that the bumper will prevent the blade from touching the window frame when the blade is abutted against the widow pane.

In these respects, the window paint scraper according to the present invention substantially departs from the conventional concepts and designs of the prior art, and in so doing provides an apparatus primarily developed for the purpose of scraping paint from a window while protecting the window frame from the blade.

SUMMARY OF THE INVENTION

In view of the foregoing disadvantages inherent in the known types of paint scrapers now present in the prior art, the present invention provides a new window paint scraper construction wherein the same can be utilized for scraping paint from a window while protecting the window frame from the blade.

The general purpose of the present invention, which will be described subsequently in greater detail, is to provide a new window paint scraper apparatus and method which has many of the advantages of the paint scrapers mentioned heretofore and many novel features that result in a new window paint scraper which is not anticipated, rendered obvious, suggested, or even implied by any of the prior art paint scrapers, either alone or in any combination thereof.

To attain this, the present invention generally comprises a head portion, a distal end, a proximal end, and a pair of sides. The distal end has a slot therein adapted for removably receiving a blade. A sharp edge of the blade extends away from the distal end. The sharp edge has a width generally equal to a width of the distal end. A handle portion is elongate and is integrally coupled to the proximal end of the head portion. A pair of spacing members places a distance between the sides of the head portion and a window frame. Each of the spacing members is integrally coupled to one of the sides of the head portion. Each of the spacing members is abutted against a junction of the sides and the distal end of the head portion. A bumper protects the widow frame from the sharp edge of the blade. The bumper is integrally coupled to and extends away from the distal end of the head portion. The bumper extends away from the distal end such that the bumper will prevent the blade from touching the window frame when the blade is abutted against the widow pane.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new window paint scraper apparatus and method which has many of the advantages of the paint scrapers mentioned heretofore and many novel features that result in a new window paint scraper which is not anticipated, rendered obvious, suggested, or even implied by any of the prior art paint scrapers, either alone or in any combination thereof.

It is another object of the present invention to provide a new window paint scraper which may be easily and efficiently manufactured and marketed.

It is a further object of the present invention to provide a new window paint scraper which is of a durable and reliable construction.

An even further object of the present invention is to provide a new window paint scraper which is susceptible of a low cost of manufacture with regard to both materials and labor, and which accordingly is then susceptible of low prices of sale to the consuming public, thereby making such window paint scraper economically available to the buying public.

Still yet another object of the present invention is to provide a new window paint scraper which provides in the apparatuses and methods of the prior art some of the advantages thereof, while simultaneously overcoming some of the disadvantages normally associated therewith.

Still another object of the present invention is to provide a new window paint scraper for scraping paint from a window while protecting the window frame from the blade.

Yet another object of the present invention is to provide a new window paint scraper which includes a head portion, a distal end, a proximal end, and a pair of sides. The distal end has a slot therein adapted for removably receiving a blade. A sharp edge of the blade extends away from the distal end. The sharp edge has a width generally equal to a width of the distal end. A handle portion is elongate and is integrally coupled to the proximal end of the head portion. A pair of spacing members places a distance between the sides of the head portion and a window frame. Each of the spacing members is integrally coupled to one of the sides of the head portion. Each of the spacing members is abutted against a junction of the sides and the distal end of the head portion. A bumper protects the widow frame from the sharp edge of the blade. The bumper is integrally coupled to and extends away from the distal end of the head portion. The bumper extends away from the distal end such that the bumper will prevent the blade from touching the window frame when the blade is abutted against the widow pane.

Still yet another object of the present invention is to provide a new window paint scraper that has a protective covering for safe storage.

Even still another object of the present invention is to provide a new window paint scraper that protects the frame without the need for additional guides.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a schematic perspective view of a new window paint scraper according to the present invention.

FIG. 2 is a schematic top view of an alternate embodiment of the present invention including alternate spacing of bumpers and including an indentation for gripping purposes.

DESCRIPTION OF THE PREFERRED EMBODIMENT

Figure 3:
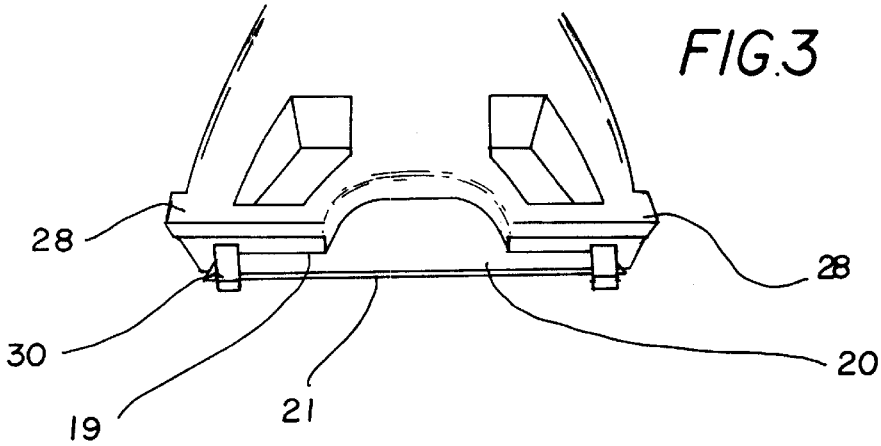
FIG. 3 is a schematic front view of the present invention.
Figure 5:
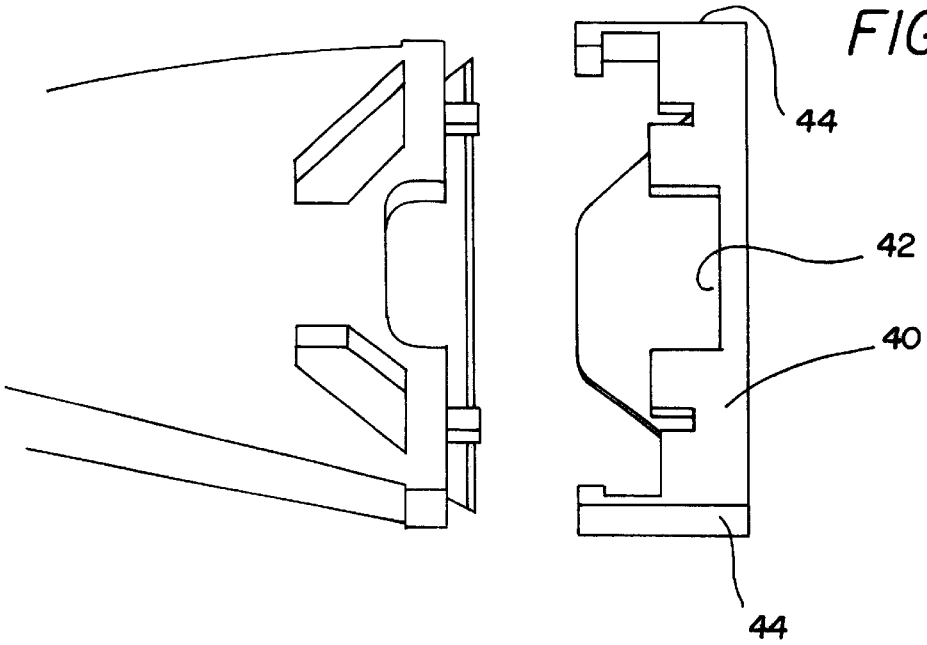
FIG. 5 is a schematic perspective view of the present invention.
Figure 4:
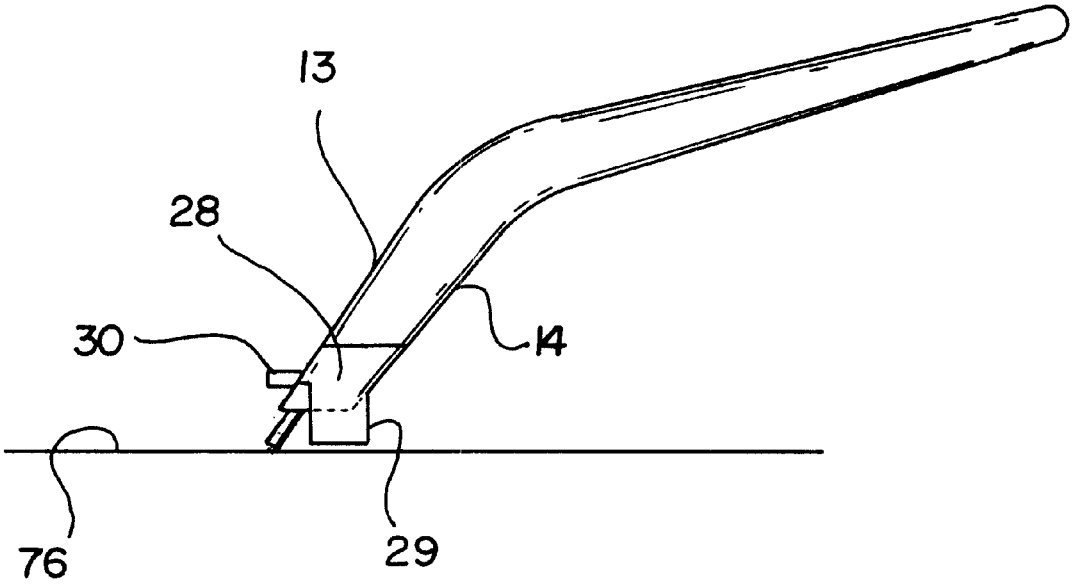
FIG. 4 is a schematic side view of the present invention.
Figure 6:
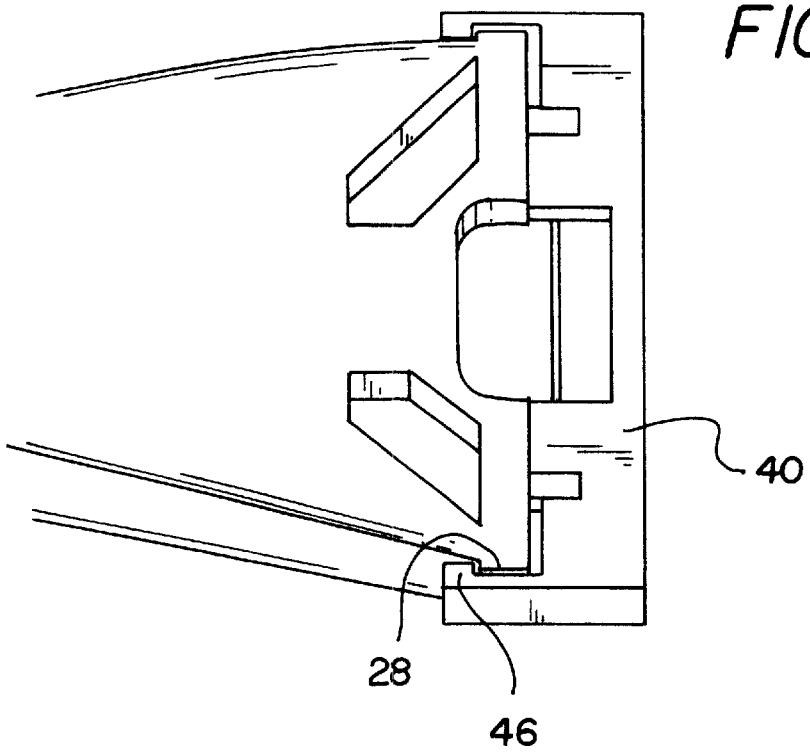
FIG. 6 is a schematic perspective view of the present invention.

With reference now to the drawings, and in particular to FIGS. 1 through 6 thereof, a new window paint scraper embodying the principles and concepts of the present invention and generally designated by the reference numeral 10 will be described.

As best illustrated in FIGS. 1 through 6, the window paint scraper 10 generally comprises a head portion 12. The head portion has a top side 13, a bottom side 14, a distal end 15, a proximal end 16, a first side 17 and a second side 18. The distal end 15 has a width greater than a width of the proximal end 16. The distal end 15 has a slot 19 therein adapted for removably receiving a blade 20. Alternatively, the blade 20 may be a fixed blade. For removable blades, any conventional method for securing a blade in a window paint scraper may be used. A sharp edge 21 of the blade 20 extends away from the distal end 15. The sharp edge 21 has a width generally equal to a width of the distal end 15. Preferably the sharp edge 21 of the blade 20 has a width greater than an opposite dull edge of the blade 20. The distal end 15 may also have a pair of spaced grooves 22 therein which travel on the top side 13 of the head portion 12. The grooves 22 help catch the paint and move it out of the way.

An elongate handle portion 24 has an end that is integrally coupled to the proximal end 16 of the head portion 12. The handle portion 24 is in angular relation to the head portion 12. Preferably, the angle formed by the handle portion and the head portion is generally between 120 and 150 degrees. The handle portion 24 has a top side having an indentation 25 therein. The indentation 25 is positioned generally adjacent to the proximal end 16 of the head portion 12. The indentation 25 has a roughened surface. The user may place their thumb in the indentation for greater control of the device. The head portion 12 and the handle portion 24 are preferably made from a plastic material.

A pair of spacing members 28 place a distance between the sides 17, 18 and the window frame. Each of the spacing members 28 is integrally coupled to one of the sides 17, 18 of the head portion. Each of the spacing members is abutted against a junction of the sides and the distal end 15 of the head portion 12. The spacing members 28 extend downward away from the top side 13 of the head portion 12. Each of the spacing members 28 extends in a direction orientated generally perpendicular to the handle portion 24. Each of the spacing members 28 has a free end 29. A distance between the head portion 12 and the free ends 29 is less than a distance between the sharp edge 21 of the blade 20 and the head portion 12. The spacing members 28 allow the user to slide the device on the windowpane 76 while it is against the window frame 78. The spacing members 28 keep the blade 20 away from the frame 78 so that the frame 78 or the material sealing the windowpane 76 in the frame 78 is not damaged by the outside edge of the blade 20. Ideally, each of the spacing members 28 has a width equal to 2 millimeters.

At least one bumper 30 protects the widow frame 78 from the sharp edge 21 of the blade 20. Ideally, two or more bumpers 30, or lugs, are used. Each of the bumpers 30 is integrally coupled to the distal end 15 of the head portion 12. The bumpers 30 are spaced from each other. The bumpers 30 extend in a direction orientated generally parallel to the handle portion 24. Each of the bumpers 30 is generally adjacent to the top side 13 of the head portion 12. Each of the bumpers 30 extends a distance from the distal end 15 such that the bumpers 30 extend beyond the sharp edge 21 of the blade 20 when the free ends 29 of the spacing members 28 are abutted against the windowpane 76. Ideally, the bumpers 30 and the spacing members 28 are orientated substantially perpendicular to each other and the blade 20 is between the spacing members 28 and bumpers 30. The bumpers 30 extend further away from the distal end 15 than the blade 20 and the spacing members 28, and the blade 20 extends further than the spacing members 28. This allows a scraping edge against the windowpane 76 but does not allow the blade 20 to hit the frame 78 before the bumpers 30.

A covering means 40 covers the blade 20. The covering means 40 is a housing having a slot 42 therein. The slot 42 is adapted for receiving the sharp edge 21 of the blade 20. The housing 40 has a pair of sides 44 each having a coupler 46 thereon. Each of the couplers 46 comprises a hook for removably coupling to one of the spacing members 28.

Figure 7:
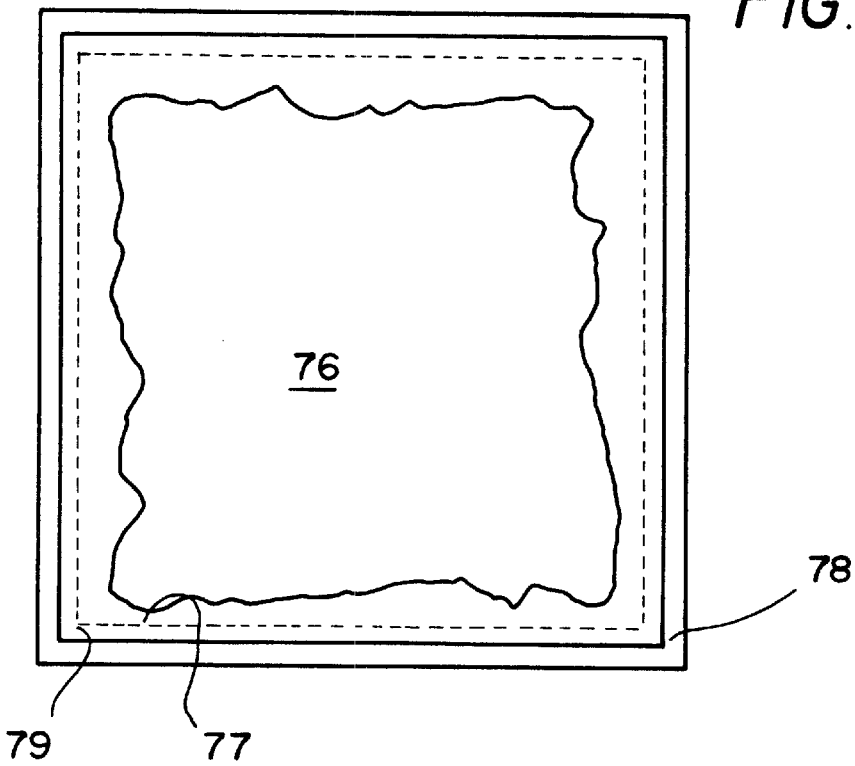
FIG. 7 is a schematic front view of a windowpane and window frame.

In use, the user scrapes paint 77 from the windowpane 76 by sliding the blade 20 against the windowpane. The spacing members 28 are slid against the frame 78 and the user continues until the bumper hits a portion of the frame 78. The device 10 is then turned accordingly so that the device 10 may be slid along another juncture of the windowpane 76 and the window frame 78. The spacing members 28 allow a buffer 79 of paint to remain adjacent to the frame. The buffer 79 is the area in FIG. 7 between the dashed line and the window frame 78. This protects the frame 78 and any caulking or other type of sealant which may be at the juncture of the window frame 78 and windowpane 76.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the cope of the invention.

We claim:

1. A window paint scraper for scraping paint off of a windowpane while leaving a portion of paint on the windowpane generally adjacent to a window frame supporting the windowpane, said window paint scraper comprising:

a head portion, a distal end, a proximal end, and a pair of sides, said distal end having a slot therein adapted for removably receiving a blade, a sharp edge of said blade extends away from said distal end, said sharp edge having a width generally equal to a width of said distal end;

a handle portion, said handle portion being elongate and being integrally coupled to said proximal end of said head portion;

a pair of spacing members for placing a distance between said sides of said head portion and the window frame, each of said spacing members being integrally coupled to one of said sides of said head portion, each of said spacing members being abutted against a junction of said sides and said distal end of said head portion;

a bumper for protecting the widow frame from said sharp edge of said blade, said bumper being integrally coupled to and extending away from said distal end of said head portion, said bumper extending away from said distal end such that said bumper will prevent said blade from touching said window frame when said blade is abutted against the windowpane.

2. The window paint scraper as in claim 1, wherein said handle portion is elongate, said handle portion being in angular relation to said head portion.

3. The window paint scraper as in claim 2, wherein each of said spacing members extends downward away from a top side of said head portion, each of said spacing members extending in a direction orientated generally perpendicular to said handle portion, each of said spacing members having a free end, a distance between said head portion and said free ends being less than a distance between said sharp edge of said blade and said head portion.

4. The window paint scraper as in claim 3, wherein said bumper is a pair of bumpers, each of said bumpers being integrally coupled to said distal end of said head portion, said bumpers being spaced, said bumpers extending in a direction orientated generally parallel to said handle portion, each of said bumpers being generally adjacent to said top side of said head portion, each of said bumpers extending a distance from said distal end such that said bumpers extend beyond said sharp edge of said blade when said free ends of said spacing members are abutted against the windowpane.

5. The window paint scraper as in claim 4, further comprising a covering means for covering the blade, said covering means being a housing having a slot therein, said slot being adapted for receiving said sharp edge of said blade, said housing having a pair of sides each having a coupler thereon, each of said couplers comprising a hook for removably coupling to one of said spacing members.

6. The window paint scraper as in claim 1, further comprising a covering means for covering the blade, said covering means being a housing having a slot therein, said slot being adapted for receiving said sharp edge of said blade, said housing having a pair of sides each having a coupler thereon, each of said couplers comprising a hook for removably coupling to one of said spacing members.

7. A window paint scraper for scraping paint off of a windowpane while leaving a portion of paint on the windowpane generally adjacent to a window frame supporting the windowpane, said window paint scraper comprising:

a head portion, said head portion having a top side, a bottom side, a distal end, a proximal end, a first side and a second side, said distal end having a width greater than a width of said proximal end, said distal end having a slot therein adapted for removably receiving a blade, wherein a sharp edge of said blade extends away from said distal end, said sharp edge having a width generally equal to a width of said distal end;

a handle portion, said handle portion being elongate, said handle portion having an end being integrally coupled to said proximal end of said head portion, said handle portion being in angular relation to said head portion, said handle portion having a top side having an indentation therein, said indentation being positioned generally adjacent to said proximal end of said head portion, said indentation having a roughened surface, an angle formed by said handle portion and said head portion being generally between 120 and 150 degrees;

a pair of spacing members for placing a distance between said first and second sides and said window frame, each of said spacing members being integrally coupled to one of said first and second sides of said head portion, each of said spacing members being abutted against a junction of said first and second sides and said distal end of said head portion, each of said spacing members extending downward away from said top side of said head portion, each of said spacing members extending in a direction orientated generally perpendicular to said handle portion, each of said spacing members having a free end, a distance between said head portion and said free ends being less than a distance between said sharp edge of said blade and said head portion;

a pair of bumpers for protecting the widow frame from said sharp edge of said blade, each of said bumpers being integrally coupled to said distal end of said head portion, said bumpers being spaced, said bumpers extending in a direction orientated generally parallel to said handle portion, each of said bumpers being generally adjacent to said top side of said head portion, each of said bumpers extending a distance from said distal end such that said bumpers extend beyond said sharp edge of said blade when said free ends of said spacing members are abutted against the windowpane; and a covering means for covering the blade, said covering means being a housing having a slot therein, said slot being adapted for receiving said sharp edge of said blade, said housing having a pair of sides each having a coupler thereon, each of said couplers comprising a hook for removably coupling to one of said spacing members.

8. A window paint scraper for scraping paint off of a windowpane while leaving a portion of paint on the windowpane generally adjacent to a window frame supporting the windowpane, said window paint scraper comprising:

a head portion, a distal end, a proximal end, and a pair of sides, said distal end having a slot therein adapted for removably receiving a blade, a sharp edge of said blade extends away from said distal end, said sharp edge having a width generally equal to a width of said distal end;

a handle portion, said handle portion being elongate and being integrally coupled to said proximal end of said head portion; and a pair of spacing members for placing a distance between said sides of said head portion and the window frame, each of said spacing members being integrally coupled to one of said sides of said head portion, each of said spacing members being abutted against a junction of said sides and said distal end of said head portion.

9. The window paint scraper as in claim 8, further including a bumper for protecting the widow frame from said sharp edge of said blade, said bumper being integrally coupled to and extending away from said distal end of said head portion, said bumper extending away from said distal end such that said bumper will prevent said blade from touching said window frame when said blade is abutted against the windowpane.

10. The window paint scraper as in claim 9, wherein said bumper is a pair of bumpers, each of said bumpers being integrally coupled to said distal end of said head portion, said bumpers being spaced, said bumpers extending in a direction orientated generally parallel to said handle portion, each of said bumpers being generally adjacent to said top side of said head portion, each of said bumpers extending a distance from said distal end such that said bumpers extend beyond said sharp edge of said blade when said free ends of said spacing members are abutted against the windowpane.

11. The window paint scraper as in claim 8, wherein said handle portion is elongate, said handle portion being in angular relation to said head portion.

12. The window paint scraper as in claim 8, wherein each of said spacing members extends downward away from a top side of said head portion, each of said spacing members extending in a direction orientated generally perpendicular to said handle portion, each of said spacing members having a free end, a distance between said head portion and said free ends being less than a distance between said sharp edge of said blade and said head portion.

13. The window paint scraper as in claim 8, further comprising a covering means for covering the blade, said covering means being a housing having a slot therein, said slot being adapted for receiving said sharp edge of said blade, said housing having a pair of sides each having a coupler thereon, each of said couplers comprising a hook for removably coupling to one of said spacing members.

* * * * *